US006592511B2

(12) United States Patent
Honma et al.

(10) Patent No.: US 6,592,511 B2
(45) Date of Patent: Jul. 15, 2003

(54) INCUBATOR

(75) Inventors: Naoki Honma, Saitama (JP); Yoichi Takahashi, Saitama (JP); Tatsuhiko Seki, Saitama (JP); Kazuo Matubara, Saitama (JP)

(73) Assignee: Atom Medical Corporation, Tokyo (JP)

( * ) Notice: Subject to any disclaimer, the term of this patent is extended or adjusted under 35 U.S.C. 154(b) by 0 days.

(21) Appl. No.: 09/902,794

(22) Filed: Jul. 11, 2001

(65) Prior Publication Data

US 2002/0019578 A1 Feb. 14, 2002

(30) Foreign Application Priority Data

Jul. 14, 2000 (JP) ..... 2000-214641

(51) Int. Cl.[7] ..... A61G 11/00

(52) U.S. Cl. ..... 600/22; 292/262

(58) Field of Search ..... 292/173, 175, 292/262, 266, 273, 277; 600/22

(56) References Cited

U.S. PATENT DOCUMENTS 2,919,945 A * 1/1960 Tannen ..... 292/262
3,335,713 A * 8/1967 Grosholz et al. ..... 600/22
5,810,709 A * 9/1998 Simenauer et al. ..... 600/22

* cited by examiner

*Primary Examiner*—Max F. Hindenburg
*Assistant Examiner*—Jonathan Foreman
(74) *Attorney, Agent, or Firm*—Herbert Dubno

(57) ABSTRACT

In this incubator, the door rotation restricting means in the operating state restrains the rotation of the door in the opening direction beyond the operating angle. Thus, in the case that the door rotation restricting means is in the operating state, even if the door is pushed by the accommodated baby from the inside of the hood under the state wherein the door is not fixed by the door fixing means in a closing state, the door does not rotate in the opening direction beyond the operating angle and the angle of the door does not exceed the operating angle. Therefore, even if opening and closing operation of the nursing window is not securely performed, at least the environment inside the hood hardly deviates from the physiological environment appropriate for the accommodated baby.

7 Claims, 11 Drawing Sheets

INCUBATOR

BACKGROUND OF THE INVENTION

1. Field of the Invention

The present invention relates to an incubator designed to bring up premature babies or the like, who are not capable of adjusting their temperature or the like by themselves without help, by providing them with an appropriate physiological environment.

2. Description of the Related Art

FIGS. 1–5 illustrate a related art of the incubators. As shown in FIG. 5, the incubator 11 of the related art is installed with a transparent hood 12 on a base unit 14 on a base stand 13 for accommodating a premature baby or the like, and the hood 12 is provided with a nursing window 15 for applying treatment to the accommodated baby inside the hood 12 from the outside of the hood 12 and with a transparent door 16 made of acrylic resin for opening and closing the nursing window 15. Since rotation shafts 17 for the door 16 are provided outside the nursing window 15 and on the side of the base stand 13, the door 16 rotates by its own weight either in the direction to open or in the direction to close the nursing window 15 depending on whether the angle of the door 16 to the nursing window 15 is larger or smaller than a given angle, and the given angle is called a critical angle in the specification of the present invention.

The door 16 and the hood 12 are provided with door fixing devices 21, and the door fixing devices 21 consist of a nursing window opening and closing knob 22 rotatably installed on the door 16 and a concave nursing window opening and closing knob receiver 23 installed on the side of the hood 12. Namely, as shown in FIGS. 1 and 2, by fitting the nursing window opening and closing knob 22 into the nursing window opening and closing knob receiver 23, the door 16 is fixed by the door fixing devices 21 in the state wherein the door 16 closes the nursing window 15. The door 16 is provided with hand insertion windows 24 of one touch type, and the sides of the hood 12 are also provided with the hand insertion window 24 of one touch type and hand insertion window (not illustrated) of gather-up type.

A bed (not illustrated) for an accommodated baby is provided inside the hood 12, and bed tilting handles 25 are provided near the nursing window 15. While the bed can be tilted by manipulating one bed tilting handle 25, the height of the bed can be adjusted by simultaneously manipulating both bed tilting handles 25. A control panel 26 is provided near the bed tilting handles 25, and buttons (not illustrated), displays (not illustrated) and the like to control temperature, humidity, oxygen density and the like inside the hood 12 to appropriate values for the accommodated baby are provided on the control panel 26. The base stand 13 is installed with casters 27.

In the case of the incubator 11 of the related art such as the above, when any treatment is required to apply to an accommodated baby, a doctor, a nurse or the like releases the fixation of the door 16 by rotating the nursing window opening and closing knob 22 to remove the nursing window opening and closing knob 22 from the nursing window opening and closing knob receiver 23, opens the nursing window 15 thereafter by rotating the door 16 and applies treatment to the accommodated baby. When treatment to the accommodated baby is finished, the nursing window 15 is closed by door 16 and the door 16 is fixed in the closing state by the door fixing devices 21 in a reverse order of the operation mentioned above.

After finishing treatment to the accommodated baby, however, even if operation up to closing the nursing window 15 by the door 16 is performed, it is possible to overlook the operation to fix the door 16 in a closing state by the door fixing devices 21. Besides, if the nursing window opening and closing knob 22 is rotated to the same angle position as the angle position where the nursing window opening and closing knob 22 is fitted into the nursing window opening and closing knob receiver 23 during treatment to the accommodated baby for some reason, it is possible that though the operator thinks he or she has rotated the nursing window opening and closing knob 22 after the nursing window 15 was closed by the door 16, the nursing window opening and closing knob 22 has not actually been fitted into the nursing window opening and closing knob receiver 23, and the door 16 is not fixed by the door fixing device 21 in a closing state.

Moreover, if the inside of the hood 12 is humidified to a high humidity, the inside surface of the acrylic resin made door 16 exposed to highly humid air expands, and thereby the portion of the door 16 near the nursing window opening and closing knob 22 not supported by the rotation shaft 17 warps to the outside surface. As a result, as shown in FIGS. 3 and 4, even if the operator rotates the nursing window opening and closing knob 22 after the nursing window 15 is closed by the door 16, the nursing window opening and closing knob 22 may not be fitted into the nursing window opening and closing knob receiver 23, and thus the door 16 may not be fixed by the door fixing devices 21 in a closing state.

Furthermore, in any of these cases, if the door 16 is rotated until the angle of the door 16 to the nursing window 15 becomes smaller than the critical angle, the nursing window 15 is anyway closed by biasing force for rotating the door 16 in the direction to close the nursing window 15 by its own weight, and therefore the operator may not recognize that the door 16 is not fixed in a closing state by the door fixing devices 21.

However, since the biasing force for rotating the door 16 in the direction to close the nursing window 15 by its own weight is not strong, the door 16 is rotated to open the nursing window 15 if the door 16 is pushed from the inside of the hood 12 by the foot or the like of the accommodated baby under this state If the nursing window 15 is kept open, the environment inside the hood 12 deviates from the physiological environment appropriate for the accommodated baby and thus it is not preferable to the accommodated baby.

SUMMARY OF THE INVENTION

It is accordingly an object of the present invention to provide the incubator wherein, even if opening and closing operation of the nursing window is not securely performed, the environment inside the hood can be maintained to the physiological environment appropriate for the accommodated baby or at least the environment inside the hood hardly deviates from the physiological environment appropriate for the accommodated baby.

In the incubator according to the present invention, the door rotation restricting means in the operating state restrains the rotation of the door in the opening direction beyond the operating angle. Thus, in the case that the door rotation restricting means is in the operating state, even if the door is pushed by the accommodated baby from the inside of the hood under the state wherein the door is not fixed by the door fixing means in a closing state, the door does not rotate in the opening direction beyond the operating angle and the angle of the door does not exceed the operating angle.

Even if the door rotation restricting means is in the operating state, the door rotation restricting means permits the rotation of the door within the angle between the operating angle and the angle at the state wherein the door closes the nursing window. Because of this reason, even if the door rotation restricting means is in the operating state, the door can close the nursing window by further rotating the door in the closing direction, and the operator can fix the door in a closing state by the door fixing means.

On the other hand, while the door rotates in the closing direction if the angle of the door is smaller than the critical angle, it rotates in the opening direction if the angle of the door is larger than the critical angle. Because of this reason, in the case that the operating angle is smaller than the critical angle, if the door is rotated in the closing direction until the angle of the door becomes smaller than the critical angle, the door itself further rotates in the closing direction thereafter, the angle of the door becomes smaller than the operating angle, and the door rotation restricting means gets into the operating state. Also, if the door is not rotated in the closing direction until the angle of the door becomes smaller than the critical angle, the door itself rotates in the reverse direction or in the opening direction and thereby the nursing window is opened, and the operator can immediately recognize the opening of the nursing window and thus close the nursing window again.

In the case that the operating angle is larger than the critical angle, if the door is rotated in the closing direction until the angle of the door becomes smaller than the operating angle but larger than the critical angle, although the door itself does not rotate to an angle which closes or opens the nursing window, the door rotation restricting means gets into the operating state. Also, if the door is not rotated in the closing direction until the angle of the door becomes smaller than the operating angle but larger than the critical angle, the door itself rotates in the reverse direction or in the opening direction and thereby the nursing window is opened, and the operator can immediately recognize the opening of the nursing window and thus close the nursing window again. If the door is rotated in the closing direction until the angle of the door becomes smaller than the critical angle, the door itself further rotates in the closing direction as well as the door rotation restricting means gets into the operating state.

Therefore, even if the operation up to closing the nursing window by the door and fixing the door in the closing state by the door fixing means is not securely performed, the angle of the door does not become larger than the operating angle, and also even if the door rotation angle is not sufficient when the nursing window is closed, the operator can immediately recognize the opening of the nursing window and thus can close the nursing window again. Because of this reason, even if opening and closing operation of the nursing window is not securely performed, the environment inside the hood can be maintained to the physiological environment appropriate for the accommodated baby or at least the environment inside the hood hardly deviates from the physiological environment appropriate for the accommodated baby.

In the preferred incubator of the present invention, the operating angle is smaller than the critical angle. Because of this reason, in the case that the door rotation restricting means is in the operating state, even if the door is pushed by the accommodated baby from the inside of the hood under the state wherein the door is not fixed by the door fixing means in a closing state, the door itself rotates in the reverse direction or in the closing direction and thereby the angle of the door becomes smaller than the operating angle once the accommodated baby stops pushing the door from the inside of the hood. Thus, the environment inside the hood further hardly deviates from the physiological environment appropriate for the accommodated baby.

In the preferred incubator of the present invention, the door rotation restricting means is provided with the operation canceling member for canceling the operating state. Because of this reason, even if the door rotation restricting means is in the operating state, the nursing window can be opened by canceling this operating state with the operation canceling member. Thus, any treatment to the accommodated baby is not hindered by the door rotation restricting means.

DETAILED DESCRIPTION OF THE PREFERRED EMBODIMENT

Figure 11:
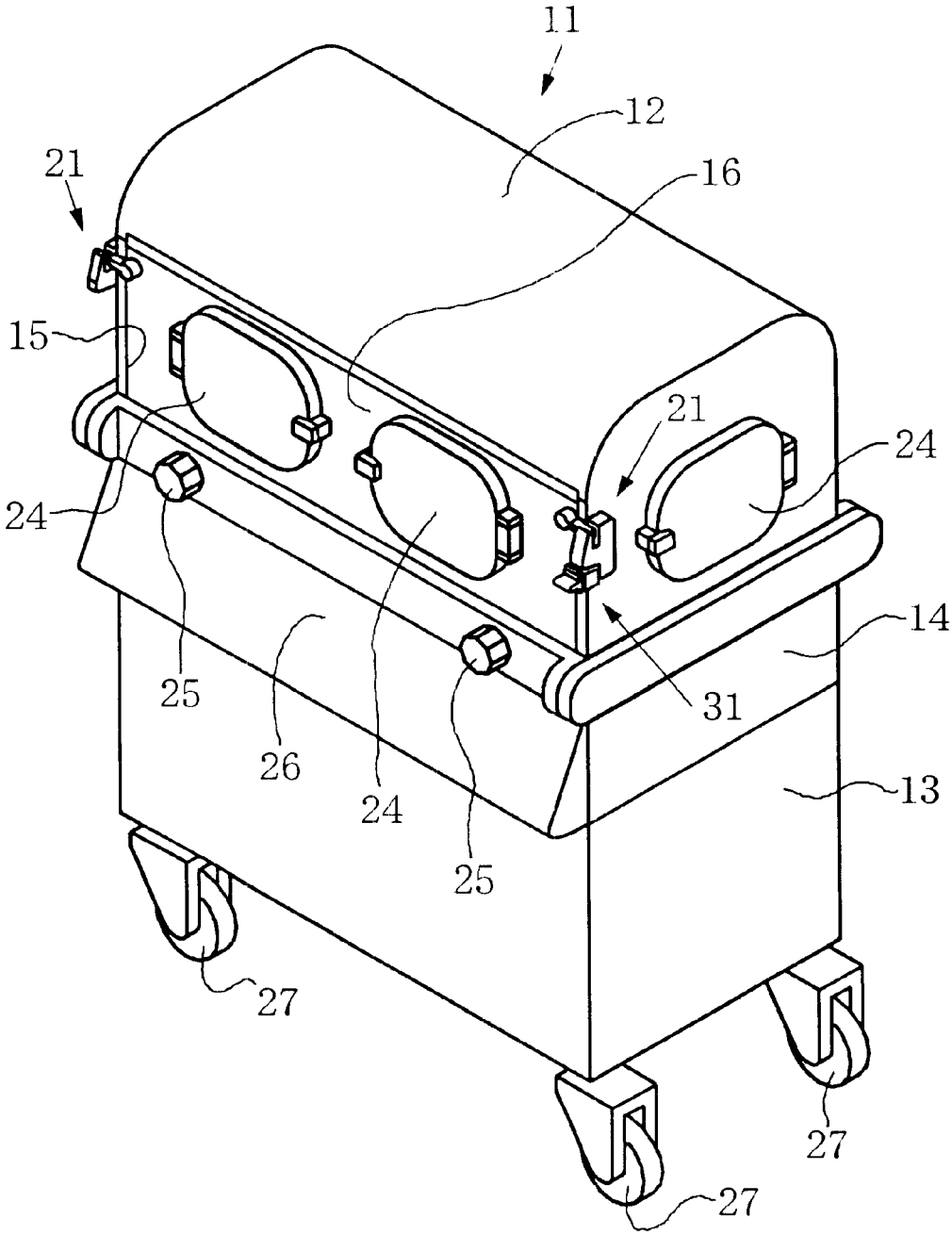
FIG. 11 is a perspective view showing the whole of one embodiment of the present invention.

An embodiment of the present invention will now be described with reference to FIGS. 6–11. As shown in FIG. 11, an incubator 11 of the present embodiment also has the substantially same construction as that of the incubator 11 of one related art as shown in FIGS. 1–5 except that a main body 32 of a door rotation restricting device 31 is installed on the door 16 near the nursing window opening and closing knob 22 of one door fixing device 21 and that the door rotation restricting device 31 gets into an operating state by engagement of the nursing window opening and closing knob receiver 23 of the one door fixing device 21 and the main body 32.

As shown in FIGS. 6–10, the main body 32 of the door rotation restricting device 31 is hollow, and the main body 32 is provided with a knob 33 and a projection 34. The knob 33 and the projection 34 are fixed to each other and can be moved simultaneously with respect to the main body 32. A compression spring 35 is provided in the main body 32 and the compression spring 35 biases the knob 33 and the projection 34 in one moving direction thereof. A hole 36 is formed in the nursing window opening and closing knob receiver 23 associated with the door rotation restricting device 31 and a shell 37 is formed around the hole 36. The door rotation restricting device 31 is composed of the main body 32 and the hole 36 and the shell 37 of the nursing window opening and closing knob receiver 23.

By rotating the door 16 in the direction to close the nursing window 15, the projection 34 comes into contact with the opening edge of the shell 37 when the angle of the door 16 to the nursing window 15 becomes a given angle smaller than the critical angle. If the projection 34 receives, from the opening edge of the shell 37, pressure higher than the biasing force of the compression spring 35 when the door 16 is further slightly rotated from this state, the knob 33 and the projection 34 are moved by resisting the biasing force of the compression spring 35. Because of this reason, when the projection 34 gets over the opening edge of the shell 37 by further slightly rotating the door 16, the pressure from the opening edge of the shell 37 is released, the projection 34 is inserted into the hole 36 by the biasing force of the compression spring 35, and the door rotation restricting device 31 gets into the operating state.

Figure 7:
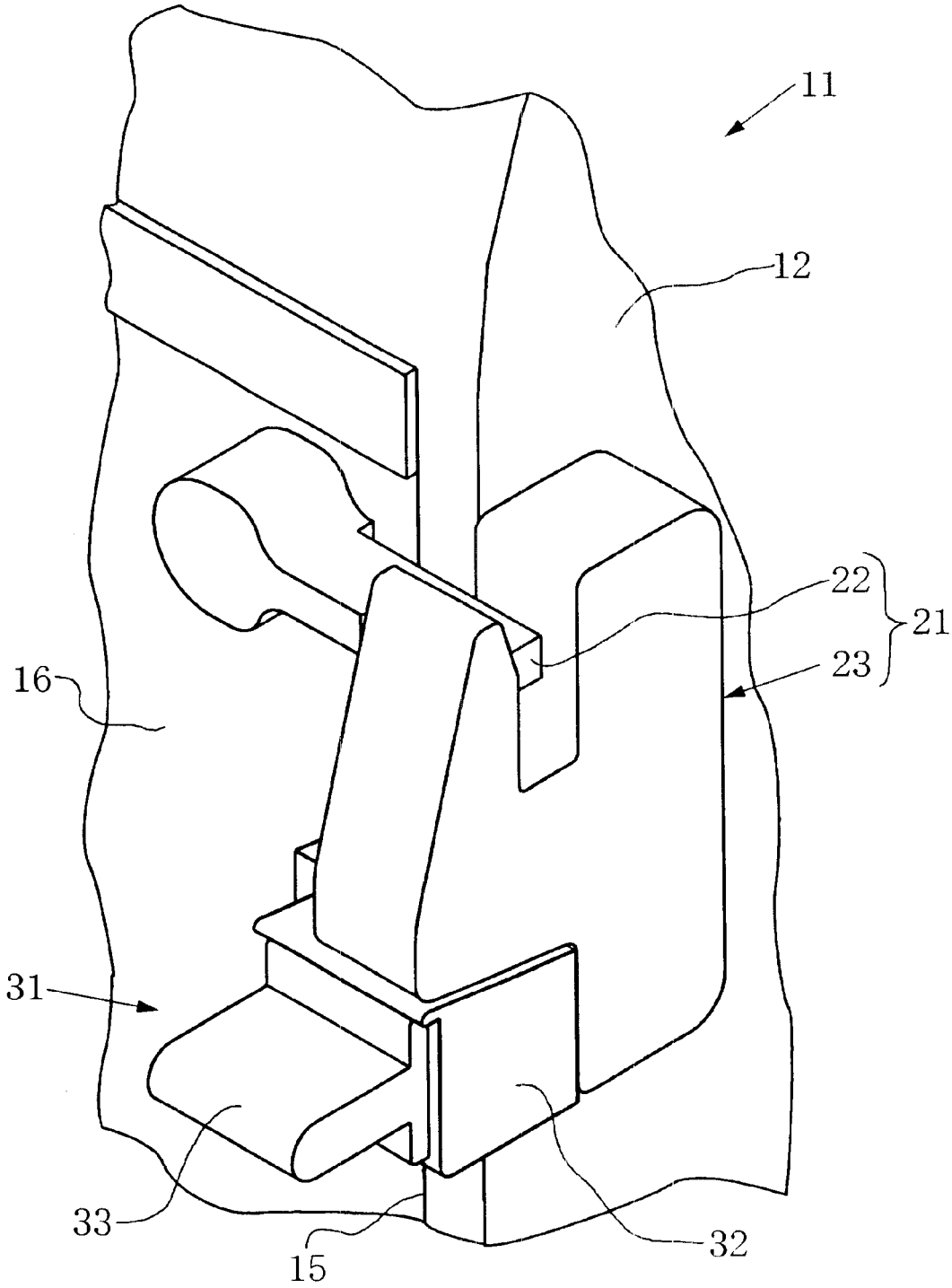
FIG. 7 shows the main portion of one embodiment of the present invention and is a perspective view in the state wherein the nursing window is closed.
Figure 8:
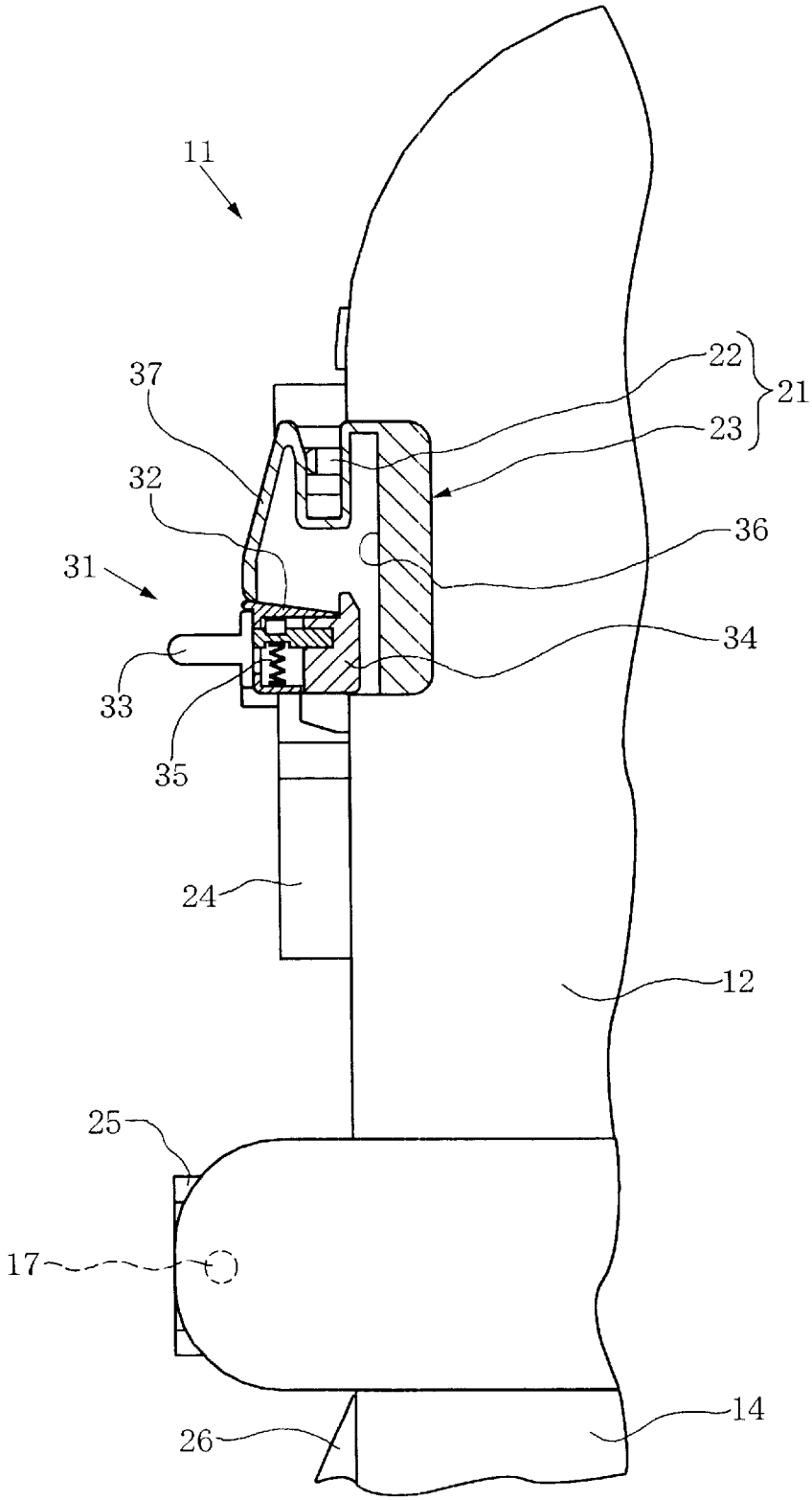
FIG. 8 shows the main portion of one embodiment of the present invention and is a partly sectional side view in the state wherein the nursing window is closed.
Figure 9:
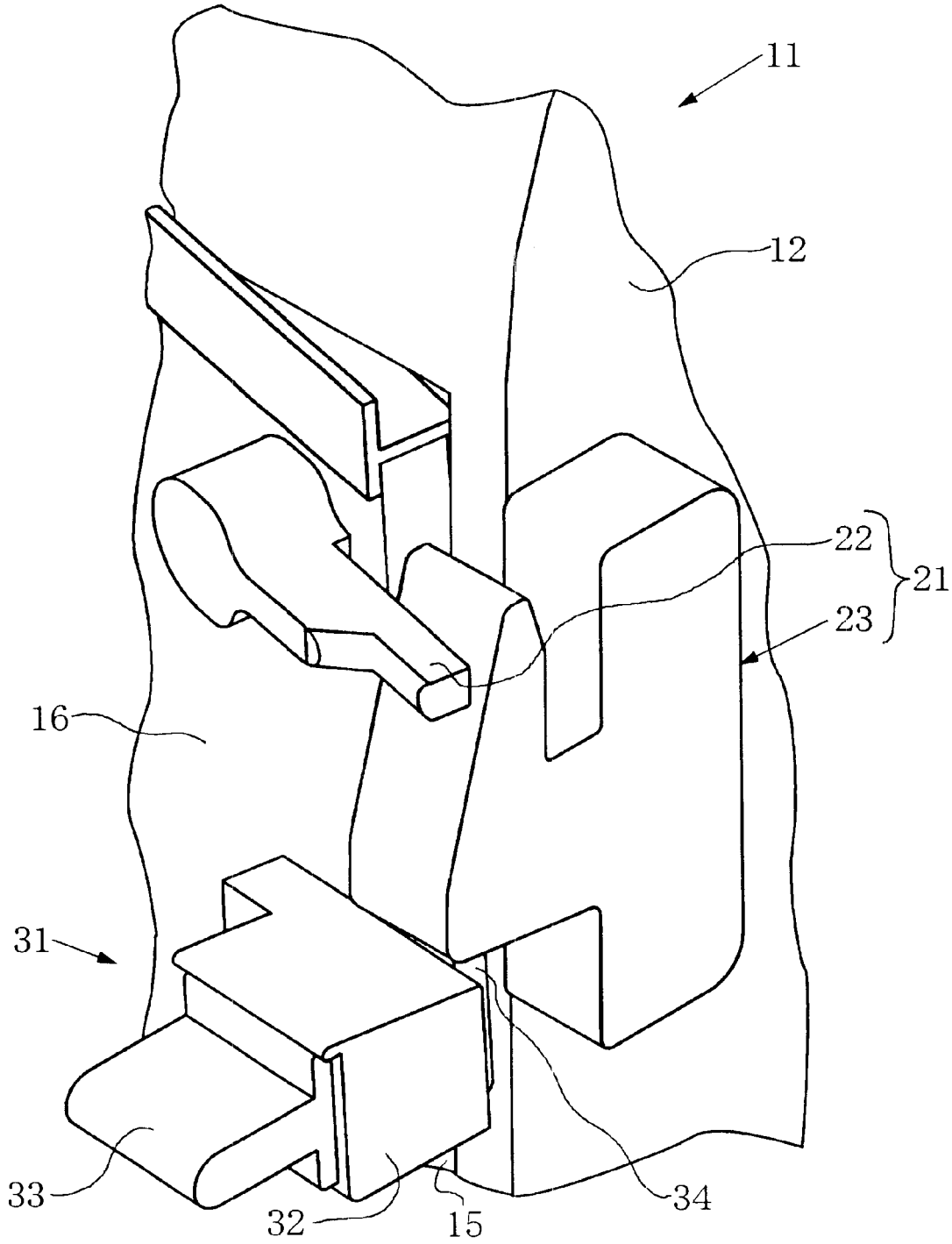
FIG. 9 shows the main portion of one embodiment of the present invention and is a perspective view in the state wherein the door closing the nursing window warps.
Figure 10:
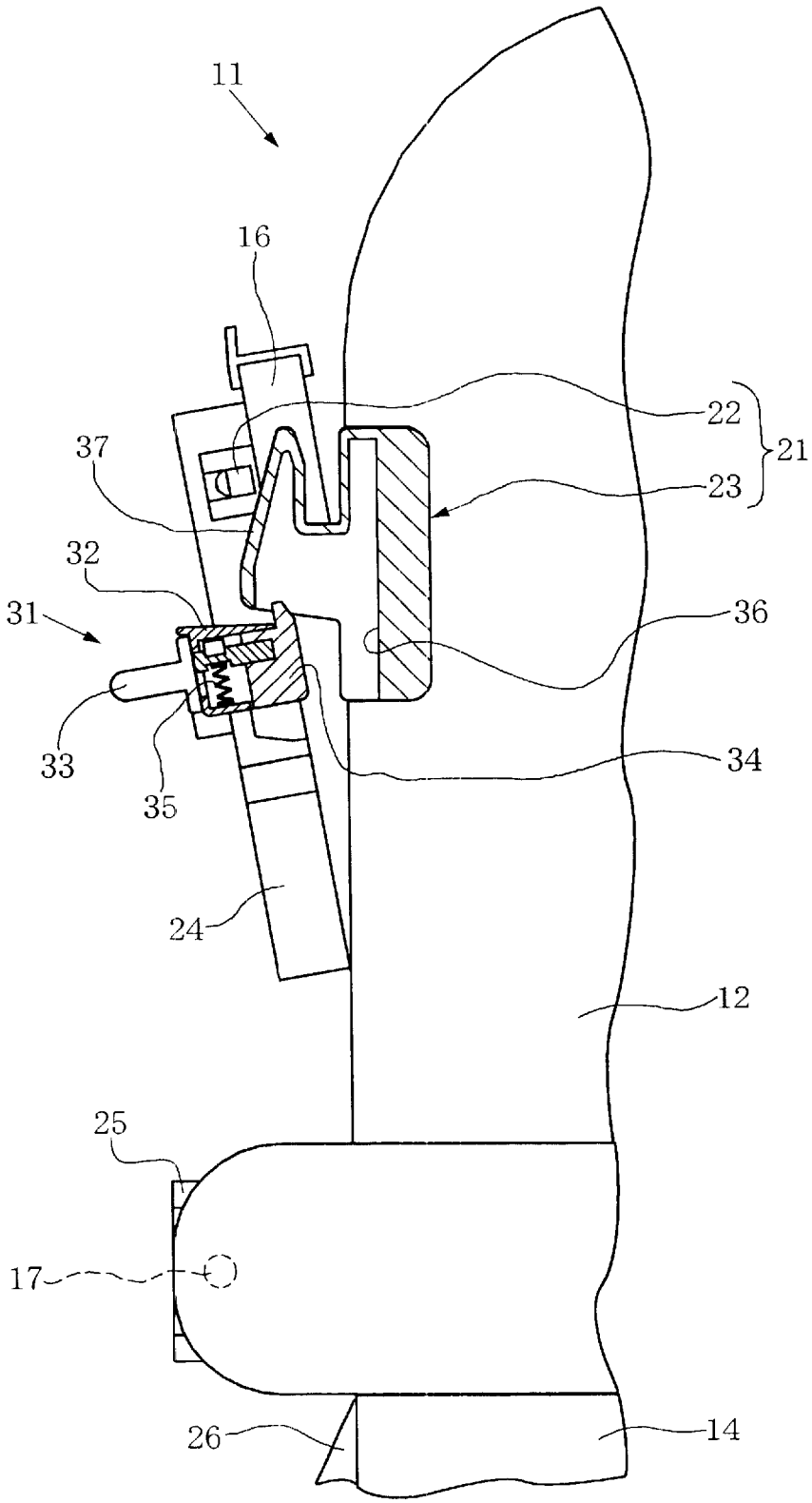
FIG. 10 shows the main portion of one embodiment of the present invention and is a partly sectional side view in the state wherein the door closing the nursing window warps.

The width of the hole 36 in the rotation direction of door 16 and the width of the portion of the projection 34 inserted into the hole 36 are so defined that, even when the door rotation restricting device 31 gets into the operating state by the projection 34 being inserted into the hole 36, the door 16 may be further rotated until the door 16 closes the nursing window 15. As shown in FIGS. 7 and 8, therefore, the door 16 can be fixed in the closing state by the door fixing device 21 even if the door rotation restricting device 31 is in the operating state.

Figure 1:
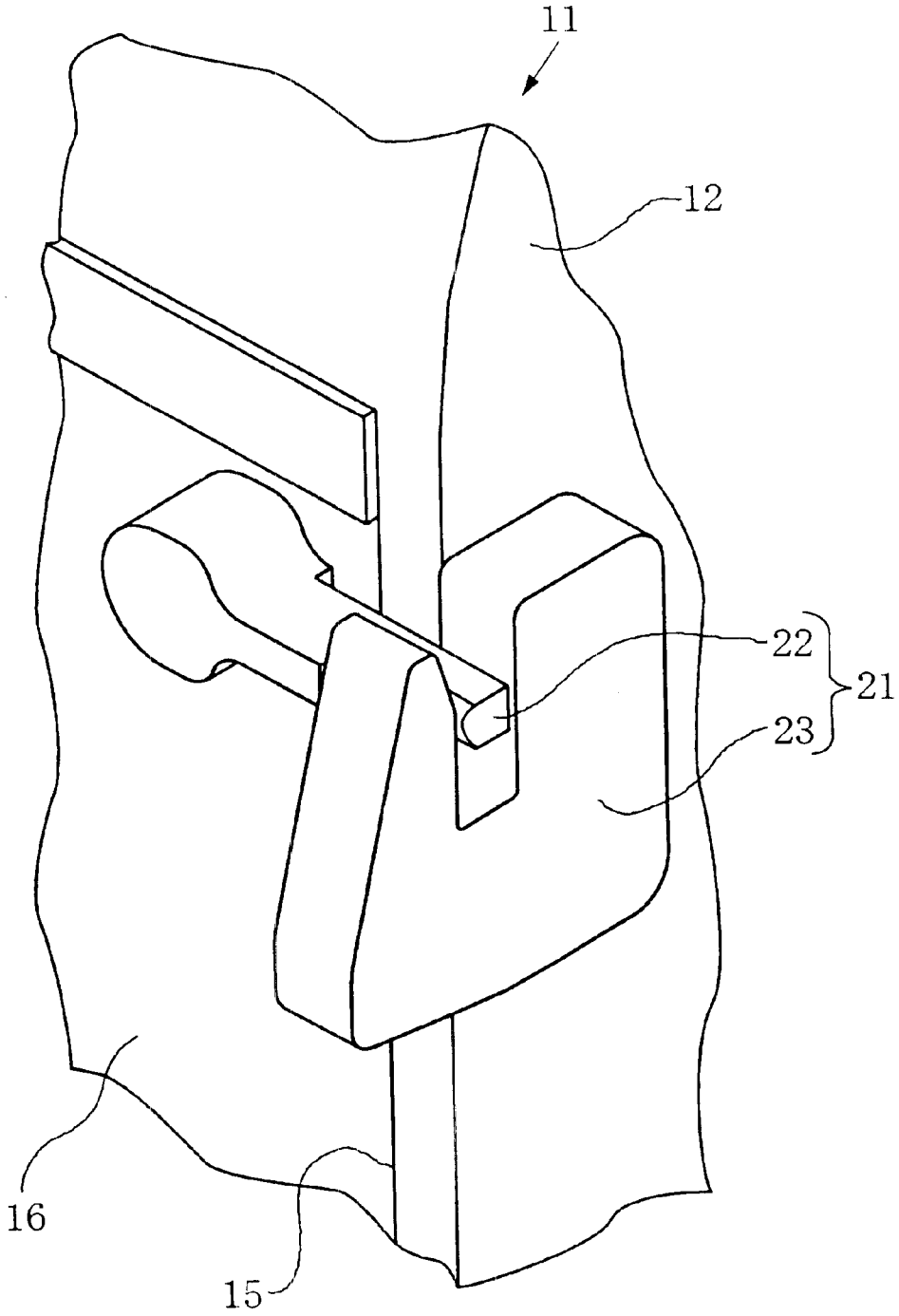
FIG.1 PRIOR ART
FIG. 1 shows the main portion of one related art of the present invention and is a perspective view in the state wherein the nursing window is closed.
Figure 2:
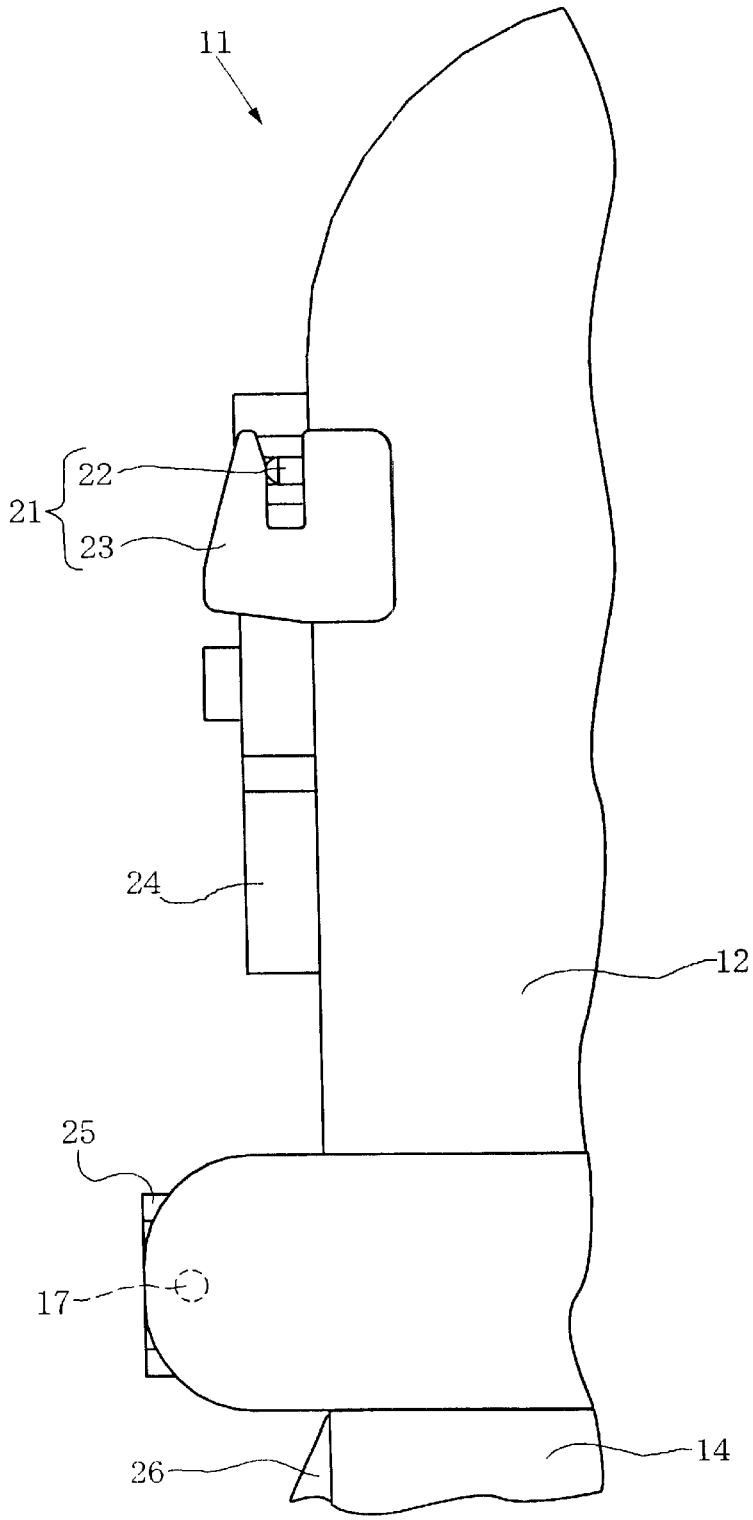
FIG.2 PRIOR ART
FIG. 2 shows the main portion of one related art of the present invention and is a side view in the state wherein the nursing window is closed.
Figure 3:
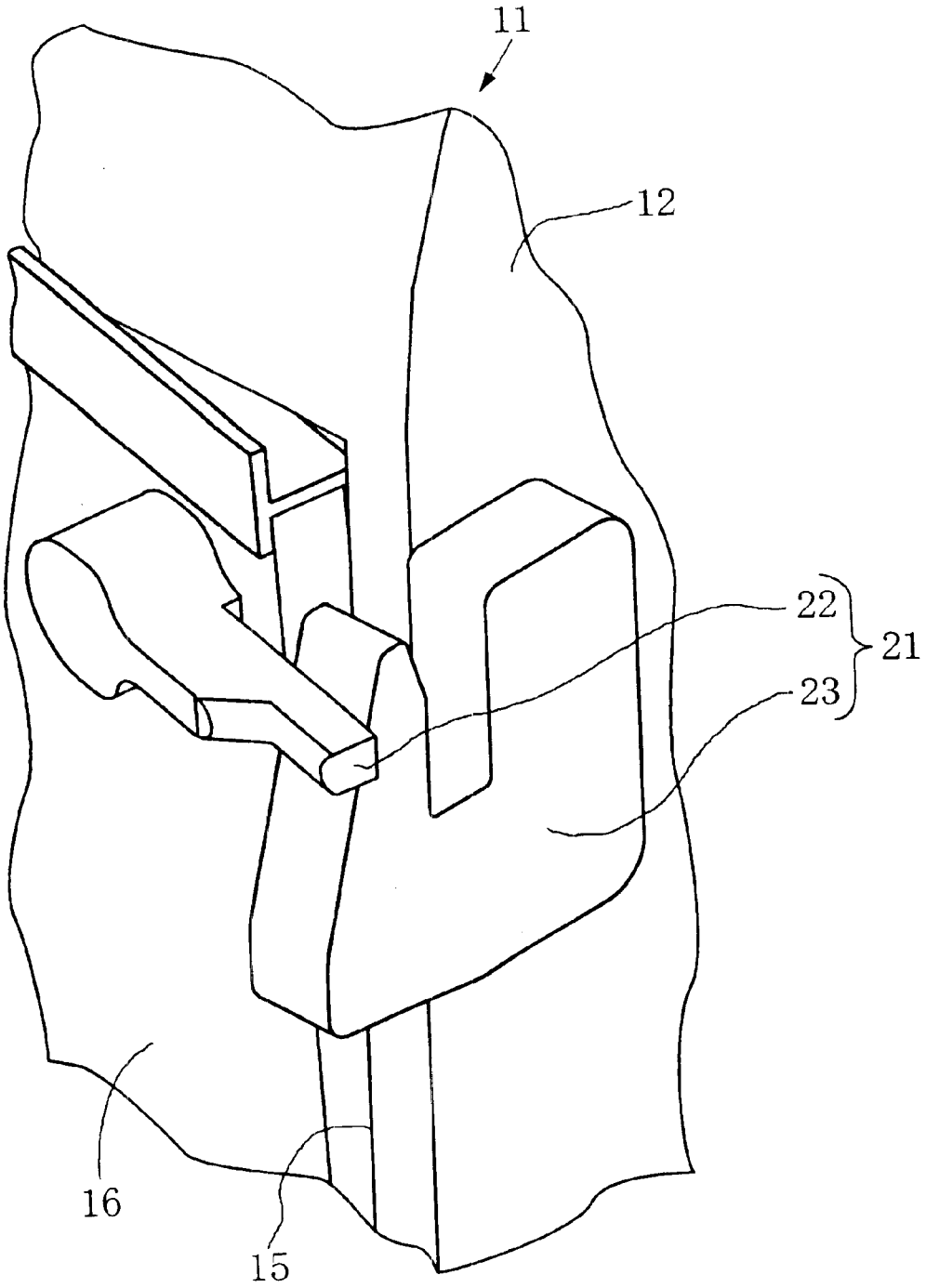
FIG.3 PRIOR ART
FIG. 3 shows the main portion of one related art of the present invention and is a perspective view in the state wherein the door closing the nursing window warps.
Figure 4:
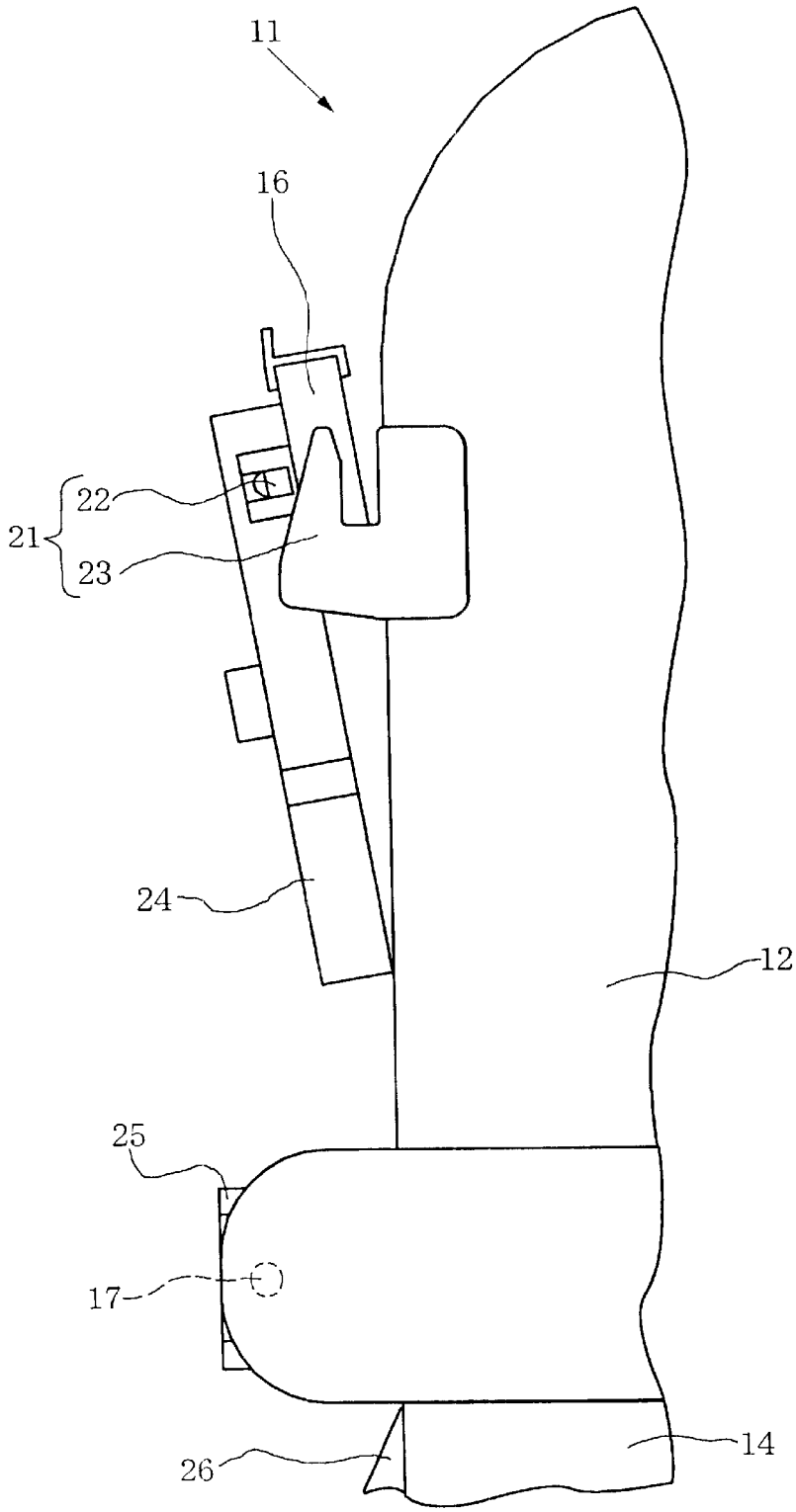
FIG.4 PRIOR ART
FIG. 4 shows the main portion of one related art of the present invention and is a side view in the state wherein the door closing the nursing window warps.
Figure 5:
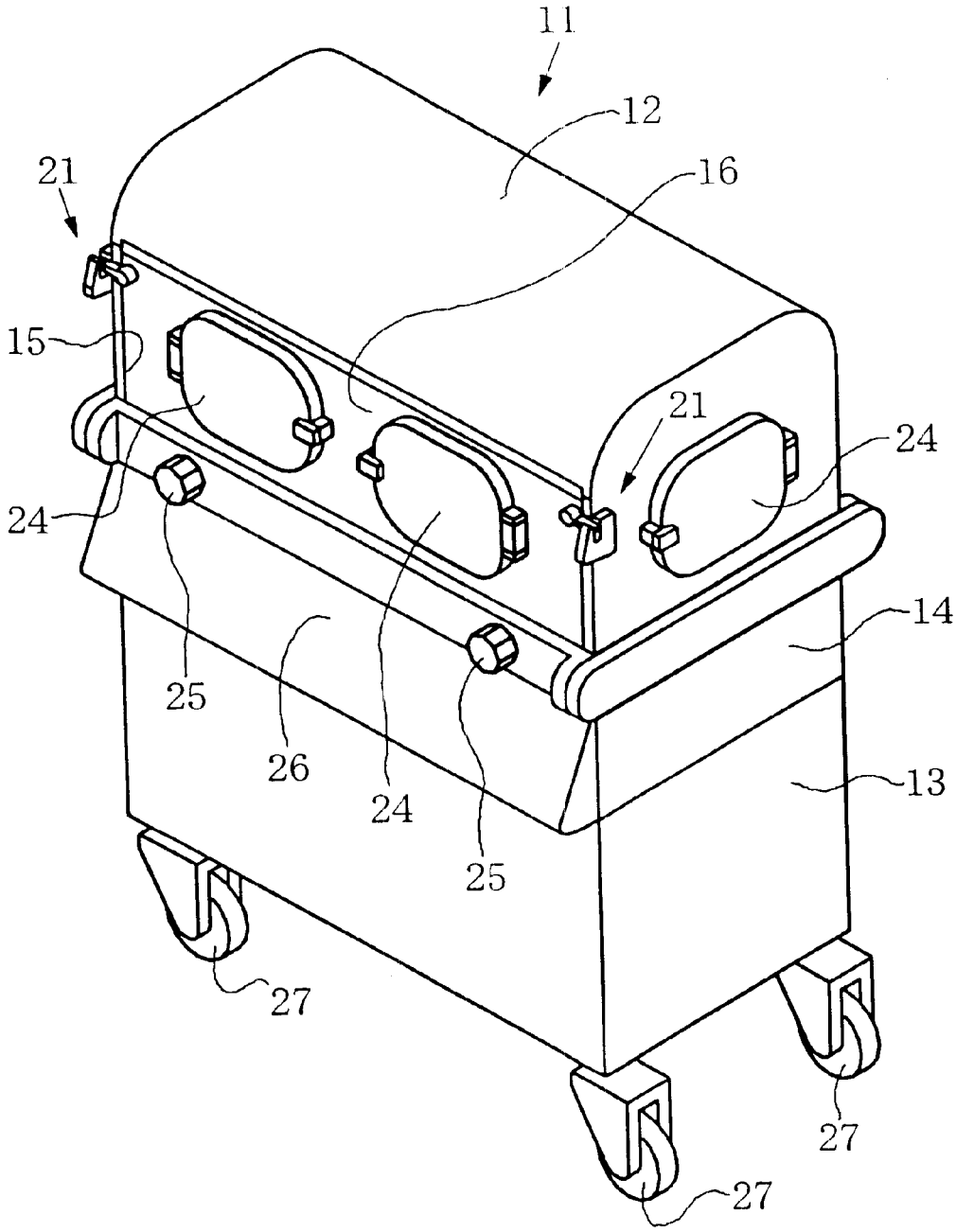
FIG.5 PRIOR ART
FIG. 5 is a perspective view showing the whole of one related art of the present invention.
Figure 6:
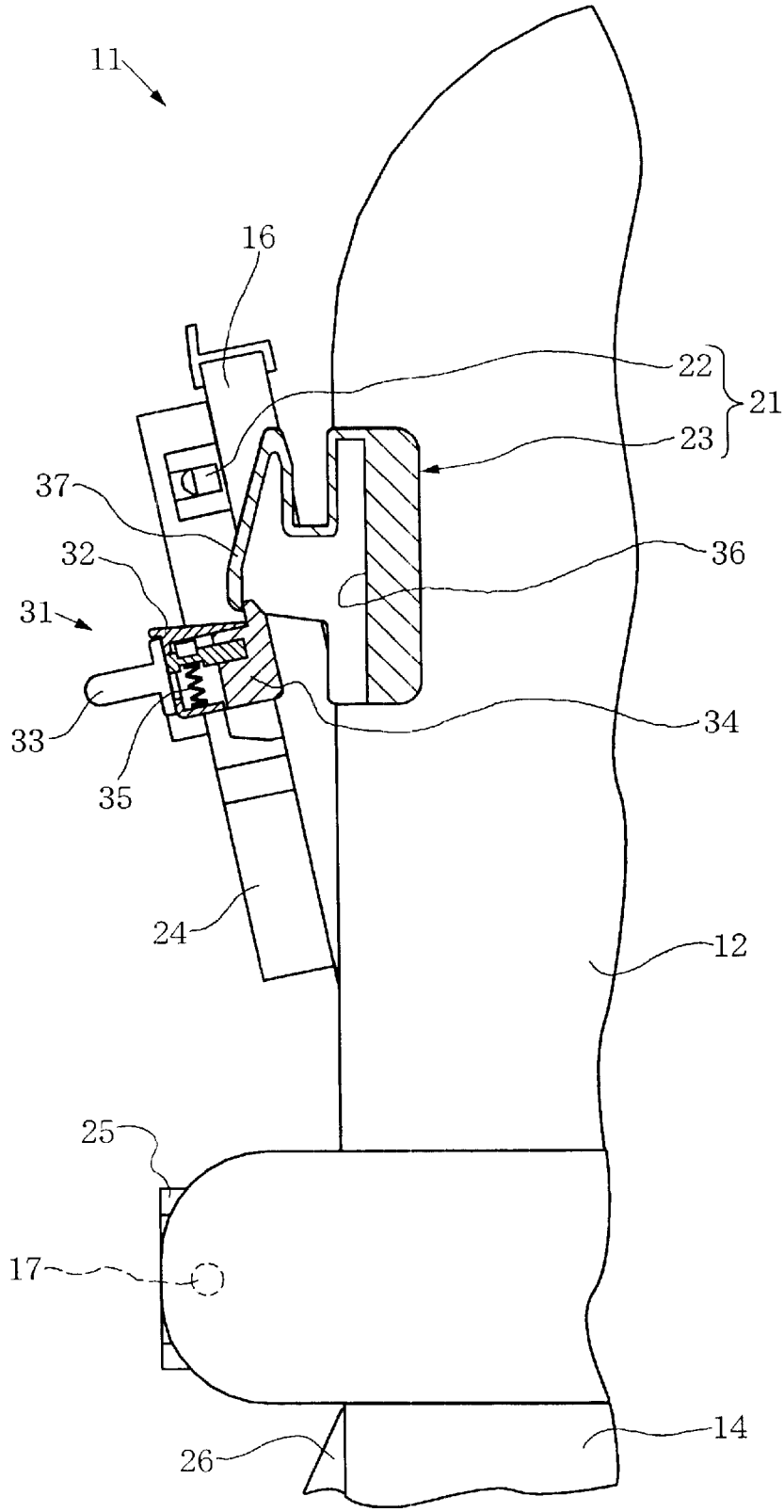
FIG. 6 shows the main portion of one embodiment of the present invention and is a partly sectional side view in the state wherein the nursing window is halfway opened.

If the door rotation restricting device 31 is in the operating state, however, the door 16 cannot be rotated beyond the angle at which the projection 32 comes into contact with the inside of the opening edge of the shell 37, as shown in FIG. 6, even in the case that the door 16 is pushed by the foot or the like of the accommodated baby from the inside of the hood 12 under the state wherein it is not fixed to the closing state by the door fixing device 21. In order to rotate the door 16 beyond the above angle and to open the nursing window 15 for applying treatment to the accommodated baby, the knob 33 is pressed by resisting the biasing force of the compression spring 35 so that the projection 34 is removed from the hole 36 and the operating state of the door rotation restricting device 31 is released. Owing to the single door rotation restricting device 31, the knob 33 can be pressed by one hand.

The angle of the door 16 to the nursing window 15 at which the door rotation restricting device 31 gets into the operating state by the projection 34 getting over the opening edge of the shell 37 and being inserted into the hole 36, or the operating angle, is larger than the angle of the door 16 which comes into contact with the outside surface of the nursing window opening and closing knob receiver 23 in the state that the nursing window opening and closing knob 22 is rotated to the same angle position as the angle position where the nursing window opening and closing knob 22 is fitted into the nursing window opening and closing knob receiver 23. Accordingly, even if the door 16 is rotated in the direction to close the nursing window 15 in the state that the nursing window opening and closing knob 22 is rotated to the above angle position, the door rotation restricting device 31 has already gotten into the operating state when the nursing window opening and closing knob 22 comes into contact with the outside surface of the nursing window opening and closing knob receiver 23.

Therefore, even if the door 16 is rotated in the state that the nursing window opening and closing knob 22 is rotated to the same angle position as the angle position where the nursing window opening and closing knob 22 is fitted into the nursing window opening and closing knob receiver 23, or even if the portion of the door 16 near the nursing window opening and closing knob 22 warps to the outside surface, the door rotation restricting device 31 gets into the operating state by rotating the door 16 until the angle of the door 16 becomes smaller than the operating angle.

The operating angle is smaller than the critical angle. In addition, the biasing force of the compression spring 35, and the shape and the like of the projection 34 are so defined that the pressure received by the projection 34 from the opening edge of the shell 37 when the door 16 is rotated by its own weight in the direction to close the nursing window 15 as the angle of the door 16 is smaller than the critical angle is higher than the biasing force of the compression spring 35. Because of this reason, when the nursing window 15 is closed, although the door rotation restricting device 31 does not get into the operating state if the door 16 is not rotated until the angle of the door 16 becomes smaller than the critical angle, since the door rotates by its own weight in the direction to open the nursing window 15, the operator can immediately recognize the opening of the nursing window 15 and thus close the nursing window 15 again.

To the contrary, only by rotating the door 16 until the angle of the door 16 becomes smaller than the critical angle, the door rotation restricting device 31 gets into the operating state even if the door 16 is not further rotated or the knob 33 is not pressed by resisting the biasing force of the compression spring 35 thereafter. In the case that the door rotation restricting device 31 is in the operating state, even if the door 16 is pushed by the accommodated baby from the inside of the hood 12 under the state wherein the door 16 is not fixed by the door fixing device 21 in a closing state, the door 16 rotates by its own weight in the direction to close the nursing window 15 and thereby the angle of the door 16 becomes smaller than the operating angle once the accommodated baby stops pushing the door 16 from the inside of the hood 12. Thus, the environment inside the hood 12 is maintained at the physiological environment appropriate for the accommodated baby.

The operating angle is smaller than the critical angle in the incubator 11 of the above embodiment, but the operating angle may be larger than the critical angle. In this case, if the door 16 is pushed by the foot or the like of the accommodated baby from the inside of the hood 12 under the state wherein it is not fixed to the closing state by the door fixing device 21, although it does not occur that the door 16 rotates by its own weight in the direction to close the nursing window 15 and that thereby the angle of the door 16 becomes smaller than the operating angle, it does not also occur that the angle of the door 16 becomes larger than the operating angle. Accordingly, the environment inside the hood 12 hardly deviates from the physiological environment appropriate for the accommodated baby. If the operating angle is excessively larger than the critical angle, however, the environment inside the hood 12 is subject to change when the door 16 is rotated to the operating angle and, therefore, the operating angle excessively larger than the critical angle is undesirable.

The hole 36 and the shell 37 for making the door rotation restricting device 31 into the operating state is formed in the nursing window opening and closing knob receiver 23 of the door fixing device 21 in the incubator 11 of the above embodiment, but the hole 36 and the shell 37 may be formed in an independent member separate from the door fixing device 21. Although the main body 32 of the door rotation restricting device 31 is installed on the door 16 and the hole 36 and the shell 37 are formed on the hood 12, these positional relationships may be set reversely. Moreover, although the projection 34 of the main body 32 can be moved with respect to the hole 36 and the shell 37, the hole 36 and the shell 37 may be able to be moved with respect to the projection 34 of the main body 32.

Although the door 16 rotates by its own weight either in the direction to open or in the direction to close the nursing window 15 depending on whether the angle of the door 16 to the nursing window 15 is larger or smaller than the critical angle in the incubator 11 of the above embodiment, but a biasing force other than its own weight may be applied to the door 16 to produce the rotation.

What is claimed is:

1. A baby incubator, comprising:

a hood for receiving a baby and having a nursing window;

a swingable door positioned to open and close said window and having a critical angle above which said door tends to swing into an open position away from said hood and below which said door tends to swing toward said hood to close said window;

door fixing means including a first member on said door and a second member on said hood engageable by said first member for securing said door to said hood in a closed position of said door; and door rotation restriction means including one element on said door and another element on said hood, said elements being:

engageable upon displacement of said door toward said window to an operating angle less than said critical angle and prior to closure of said window, engaging to prevent unintentional further opening of said window beyond said operating angle when said door means is unsecured and said window is at an angle less than said operating angle, enabling movement of said window between said operating angle and said closed position of said door, and manually releasable to permit swinging of said door to open said window beyond said operating angle.

2. The baby incubator as defined in claim 1 wherein said door rotation restriction means is provided with an operation canceling member for canceling an operating state thereof in which said door lies between said operating angle and said closed position.

3. The baby incubator defined in claim 1 wherein one said elements is a shell formed on one of said door and provided with an opening, said other element having a projection on the other of said hood and said door for engaging in said opening behind an edge of said shell, said door rotation restriction means including a biasing element effective to be overcome upon movement of said projection past said edge of said shell.

4. The baby incubator defined in claim 3, further comprising a knob for pressing said projection away from said edge.

5. The baby incubator defined in claim 4 wherein said shell forms one of said first and second members.

6. A baby incubator, comprising:

a hood for receiving a baby and having a nursing window;

a swingable door positioned to open and close said window and having a critical angle above which said door tends to swing into an open position away from said hood and below which said door tends to swing toward said hood to close said window;

door fixing means including a latch housing on said hood and having an upwardly open slot, and a latch pawl rotatable on said door engageable in said slot of said housing in said closed position for securing said door to said hood in a closed position of said door; and door rotation restriction means including a shell formed by said housing and having a downwardly open hole delimited by an edge spaced from said hood and defining on operating angle of said door less than said critical angle, a projection on said door engageable with said edge, and a spring biasing said projection upwardly into said hole behind said edge, said shell and said projection being:

engageable upon displacement of said door toward said window to said operating angle less than said critical angle and prior to closure of said window, engaging to prevent unintentional further opening of said window beyond said operating angle when said door means is unsecured and said window is at an angle less than said operating angle, enabling movement of said window between said operating angle and said closed position of said door, and manually releasable to permit swinging of said door to open said window beyond said operating angle.

7. The baby incubator defined in claim 6, further comprising a knob on said projection for manually displacing same away from said edge to release said door from said operating angle and enable said door to fully open.

* * * * *